US012364321B2

(12) United States Patent
Arora et al.

(10) Patent No.: US 12,364,321 B2
(45) Date of Patent: Jul. 22, 2025

(54) PACKAGED DEODORANT STICK PRODUCT

(71) Applicant: Conopco, Inc., Englewood Cliffs, NJ (US)

(72) Inventors: Amit Arora, Leeds (GB); Frank Van Der Blom, Eindhoven (NL); Timothy Huw Gray, Leeds (NL); Cornelius Sebastianus Maria Verhoeve, Veghel (NL)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 18/535,109

(22) Filed: Dec. 11, 2023

(65) Prior Publication Data

US 2024/0324752 A1 Oct. 3, 2024

Related U.S. Application Data

(63) Continuation of application No. 17/424,361, filed as application No. PCT/EP2020/051523 on Jan. 22, 2020, now Pat. No. 11,839,287.

(30) Foreign Application Priority Data

Jan. 23, 2019 (EP) ..... 19153387

(51) Int. Cl.
*A45D 40/00* (2006.01)
*A45D 40/20* (2006.01)

(52) U.S. Cl.
CPC ..... *A45D 40/00* (2013.01); *A45D 40/20* (2013.01); *A45D 2040/0012* (2013.01); *A45D 2040/0062* (2013.01)

(58) Field of Classification Search
CPC ..... A45D 40/00; A45D 40/20; A45D 2040/0012; A45D 2040/0062
See application file for complete search history.

(56) References Cited

U.S. PATENT DOCUMENTS 2,913,103 A 11/1959 Isele
3,656,628 A 4/1972 Dulberg
4,235,557 A 11/1980 Hayes
(Continued)

FOREIGN PATENT DOCUMENTS

CN 1306403 8/2001
CN 201731234 2/2011
(Continued)

OTHER PUBLICATIONS

Search Report in EP19153386; Jun. 4, 2019; European Patent Office (EPO).

(Continued)

*Primary Examiner* — Jennifer C Chiang
(74) *Attorney, Agent, or Firm* — GREENBERG TRAURIG, LLP

(57) ABSTRACT

A packaged deodorant stick product comprising a deodorant stick composition mounted on an axially immobile retaining member, the retaining member being reversibly connected to a holder enabling the deodorant stick product to be held in the human hand, wherein the retaining member comprises arcuate bridge structures separated by holes, the bridge structures arcing into the deodorant stick composition and being embedded therein.

12 Claims, 9 Drawing Sheets

(56) References Cited

U.S. PATENT DOCUMENTS

| | | | | |
|---|---|---|---|---|
| 4,915,234 | A | 4/1990 | Boeller | |
| 5,092,700 | A | 3/1992 | Susini et al. | |
| 5,240,337 | A | 8/1993 | Gruner | |
| 5,468,084 | A | 11/1995 | Boninsegni et al. | |
| 5,496,122 | A | 3/1996 | Fattori | |
| 5,738,123 | A | 4/1998 | Szekely | |
| 5,799,667 | A | 9/1998 | Szekely | |
| 5,813,784 | A | 9/1998 | Durliat | |
| 6,293,719 | B1 | 9/2001 | Ohba | |
| 6,688,795 | B1 | 2/2004 | Jacob et al. | |
| 8,651,308 | B1 | 2/2014 | Sung | |
| 8,961,048 | B2 | 2/2015 | Baines et al. | |
| 10,039,366 | B1 | 8/2018 | Facer et al. | |
| 10,492,586 | B2 | 12/2019 | Paquet | |
| 10,542,814 | B2 | 1/2020 | Kelders et al. | |
| 10,799,007 | B2 | 10/2020 | Schlatter et al. | |
| 11,406,168 | B2 | 8/2022 | Briana et al. | |
| 11,712,100 | B2 * | 8/2023 | Arora | A45D 40/00 401/98 |
| 11,839,287 | B2 | 12/2023 | Arora et al. | |
| 2005/0178785 | A1 | 8/2005 | Erickson | |
| 2006/0233589 | A1 | 10/2006 | Heukamp | |
| 2008/0145133 | A1 | 6/2008 | Palmer | |
| 2010/0129135 | A1 | 5/2010 | Stange et al. | |
| 2015/0344288 | A1 | 12/2015 | Ortega Collado | |
| 2017/0007003 | A1 | 1/2017 | Paquet | |
| 2017/0164716 | A1 | 6/2017 | Lee | |
| 2017/0215552 | A1 | 8/2017 | Keller et al. | |
| 2018/0027947 | A1 | 2/2018 | Quennessen et al. | |
| 2018/0072483 | A1 | 3/2018 | Meranus | |
| 2018/0344011 | A1 | 12/2018 | Paquet | |
| 2022/0160101 | A1 | 5/2022 | Zhou | |
| 2022/0378175 | A1 | 12/2022 | Van Der Blom et al. | |

FOREIGN PATENT DOCUMENTS

| | | |
|---|---|---|
| CN | 104687718 | 6/2015 |
| CN | 105050911 | 11/2015 |
| CN | 106572946 | 4/2017 |
| DE | 9318425 | 5/1994 |
| FR | 2726442 | 5/1996 |
| FR | 2729279 | 7/1996 |
| FR | 2882235 | 8/2006 |
| GB | 598838 | 2/1948 |
| JP | 9252837 | 9/1997 |
| JP | 10179250 | 7/1998 |
| JP | 2002291527 | 10/2002 |
| JP | 2010178828 | 8/2010 |
| JP | 2014161637 | 9/2014 |
| JP | 2015009961 | 1/2015 |
| JP | 2018153233 | 10/2018 |
| KR | 101837581 | 3/2018 |
| RU | 2199256 | 2/2003 |
| RU | 2299663 | 5/2007 |
| RU | 2438545 | 1/2012 |
| WO | WO9405180 | 3/1994 |
| WO | WO0008970 | 2/2000 |
| WO | WO2005068308 | 7/2005 |
| WO | WO2007093286 | 8/2007 |
| WO | WO2011071792 | 6/2011 |
| WO | WO2012141522 | 10/2012 |
| WO | WO2013118969 | 8/2013 |
| WO | WO2017078745 | 5/2017 |
| WO | WO2018202385 | 11/2018 |
| WO | WO2020152223 | 7/2022 |

OTHER PUBLICATIONS

Search Report in EP19153387; Jun. 4, 2019; European Patent Office (EPO).
Search Report and Written Opinion in EP19204993; Jan. 31, 2020; European Patent Office (EPO).
Search Report and Written Opinion in PCTEP2020051523; Mar. 17, 2020; World Intellectual Property Org. (WIPO).
Search Report and Written Opinion in EP20193038 ; Feb. 10, 2021; European Patent Office (EPO).
Search Report and Written Opinion in PCTEP2020079453; Nov. 11, 2020; World Intellectual Property Org. (WIPO).
Search Report and Written Opinion in PCTEP2020051524; Mar. 17, 2020; World Intellectual Property Org. (WIPO).
IRPR2 in PCTEP2020051523; Apr. 9, 2021; World Intellectual Property Org. (WIPO).
Refills; MyMyro.com; 2023; 13 pages, retrieved 2023 from https://www.mymyro.com/collections/all#refills.
Search Report and Written Opinion in PCTEP2022081277; Jan. 27, 2023; World Intellectual Property Org. (WIPO).
Search Report and Written Opinion in PCTEP2021073370; Nov. 24, 2021; World Intellectual Property Org. (WIPO).
IPRP1 in PCTEP2021073370; Mar. 9, 2023; World Intellectual Property Org. (WIPO).
IPRP1 in PCTEP2020051524; Aug. 5, 2021; World Intellectual Property Org. (WIPO).
Written Opinion of the IPEA in PCTEP2020051523; Dec. 17, 2020; World Intellectual Property Org. (WIPO).
Search Report and Written Opinion in EP23170506; Jul. 11, 2023; European Patent Office (EPO).
IPRP1 in PCTEP2020079453; May 5, 2022; World Intellectual Property Org. (WIPO).
Search Report and Written Opinion in EP21210994; May 20, 2022; European Patent Office (EPO).

* cited by examiner

PACKAGED DEODORANT STICK PRODUCT

RELATED APPLICATIONS

The present application is a continuation of U.S. National Phase application Ser. No. 17/424,361, filed on Jul. 20, 2021, which is a designated PCT of International Application No. PCT/EP2020/051523, filed on Jan. 22, 2020, which claims priority from European Patent Application No. 19153387.6, filed on Jan. 23, 2019, the contents of which are incorporated herein in their entirety for all purposes.

FIELD OF INVENTION

The field of the invention is packaged deodorant stick products, in particular the packaging/dispensers therefor.

BACKGROUND

The invention relates to a deodorant stick product (for example, a deodorant and/or antiperspirant product for application to human axillary regions) and associated packaging/dispenser. More specifically, the invention relates to a package/dispenser for deodorant stick products wherein the product is fully exposed for use on a support, which package does not require a structure for elevating the product out of the package for use.

It has been desired to provide improved packages for deodorant stick products, wherein the package is simple—that is, does not require a mechanism for elevating the product out of a housing, which mechanism increases cost of the package and makes the package more complex.

U.S. Pat. No. 5,496,122 (Mennen, 1996) discloses a replaceable stick deodorant package wherein the product is completely exposed on a retaining member and the process by which such products may be manufactured. The composition is held on a retaining member which is snap-fit assembled into a handle.

U.S. Pat. No. 4,235,557 (Ethyl Corp., 1980) discloses a dispensing device for a hot-filled solid product, such as an antiperspirant stick composition, the composition being held on a product holding structure which is screw-fitted into a handle.

SUMMARY OF INVENTION

It is an object of the present invention to provide deodorant stick compositions with a dispensing means that can be reused multiple times, thereby reducing the amount of packaging, in particular plastic packaging involved in the use of the compositions.

Current deodorant stick compositions are generally packaged in plastic dispensers, the dispenser being used until composition is exhausted and then disposed of. The present invention enables the majority of the dispensing packaging to be reused with a new composition when the original one becomes exhausted. This greatly reduces the need packaging in using the invention.

It is an object of the present invention to provide a deodorant stick products that do not require an "elevator" mechanism for their operation.

Current deodorant stick products generally comprise a stick composition surrounded on all sides by a plastic container and having some means, typically a platform and an associated spindle, designed to elevate the stick composition out of the top of the plastic container. The present invention does not require the use any such platform or spindle, further reducing the need for packaging/dispensing materials.

In a first aspect of the invention, there is provided a packaged deodorant stick product comprising a deodorant stick composition mounted on an axially immobile retaining member, the retaining member being reversibly connected to a holder enabling the deodorant stick product to be held in the human hand, wherein the retaining member comprises arcuate bridge structures separated by holes, the bridge structures arcing into the deodorant stick composition and being embedded therein.

In a second aspect of the invention, there is provided a method of applying a deodorant stick composition to the surface of the human body by use of a deodorant stick product according to the first aspect of the invention, particularly to deliver a deodorancy benefit or to reduce perspiration.

The holder enables the deodorant stick product to be easily held in one hand and for the composition to be applied to the desired surface.

A benefit of the invention is that the deodorant stick composition can be placed or replaced in its holder without need for hand contact with the deodorant stick composition.

Herein, features expressed as "preferred" with regard to a particular aspect of the invention should be understood to be preferred with regard to each aspect of the invention (likewise, features expressed as "more preferred" or "most preferred").

Herein, preferred features of the invention are particularly preferred when used in combination with other preferred features.

Herein, "ambient conditions" refers to about 20° C. and 1 atmosphere pressure, unless otherwise indicated.

Herein, all numbers, amounts and ratios may optionally be understood to be modified by the word "about", unless otherwise indicated.

Herein, the word "comprising" is intended to mean "including" but not necessarily "consisting of", i.e., it is non-exhaustive.

Herein, "cosmetic" methods and compositions should be understood to mean non-therapeutic methods and compositions, respectively.

Herein, locational terms, such as terms denoting relative positioning, such as "upper", lower", "top", "bottom", refer to the stick product orientated such the deodorant stick composition is immediately above its retaining member which is above the associated holder.

Herein, the term "deodorant stick composition" may be abbreviated to "deodorant stick" or simply "stick".

Deodorant sticks are capable of reducing body malodour following topical application. Topical application is typically achieved by drawing the top of the stick across the skin of the human body, particularly in the underarm regions.

The action of drawing the deodorant stick across the underarm regions places strong lateral forces on the stick, requiring it to have good physical strength and resistance to shear forces of this sort. The deodorant products of the present invention are especially designed to resist these forces.

Herein, deodorant sticks are typically antiperspirant stick compositions, i.e. antiperspirant sticks. Such sticks are capable of reducing perspiration, following topical application, as well as reducing body malodour. Herein, references to deodorant sticks should be understood to apply equally to antiperspirant sticks.

The deodorant sticks used in the invention are solid in nature, typically having a melting of greater than 40° C. at 1 atmosphere pressure. The deodorant stick preferably has a melting point at 1 atmosphere pressure of greater than 50° C. and more preferably greater than 60° C. Whether the melting point at 1 atmosphere pressure is greater than 40° C., 50° C. or 60° C., the melting point is preferably less than 90° C.

Herein, a deodorant stick is considered to have become molten when it is capable of flow solely under the influence of gravity and the melting point is defined as the temperature at which it becomes molten.

The deodorant stick preferably has a hardness of at least 600 gram force, most typically from 600 gram force to 5000 gram force, preferably from 750 gram force to 2000 gram force, more preferably from 800 gram force to 1400 gram force. This enables the stick to withstand the lateral forces encountered when it is topically applied. More particularly, it enables the stick to stay attached to its retaining member during such use.

Herein, the term "hardness" relates to how much force is required to move a penetration cone a specified distance and at a controlled rate into a deodorant stick composition under the following test conditions. Values are measured at 27° C., 15% relative humidity, using a TA-XT2 Texture Analyzer, available from Texture Technology Corp., Scarsdale, NY, USA. The product hardness value represents the peak force required to move a standard 45° angle penetration cone through the composition for a distance of 10 mm at a rate of 2 mm/second. The standard cone is available from Texture Technology Corp., as part number TA-15, and has a total cone length of about 24.7 mm, angled cone length of about 18.3 mm, a maximum diameter of the angled surface of the cone of about 15.5 mm. The cone is a smooth, stainless steel construction and weighs 17.8 grams.

Deodorant sticks of the invention typically do not require a plastic spindle running through them to aid in their elevation from their packaging; indeed, the absence of a central spindle running through the deodorant stick composition is a preferred feature of deodorant stick products of the present invention. The lack of a central spindle can have a detrimental effect of the structural strength of the stick and leads to relatively low preferred ratios of stick height to other dimensions (vide infra).

In preferred embodiments, the ratio of the height to the breadth of the deodorant stick composition is from 1:2 to 3:2. It is particularly preferred that this ratio is from 2:3 to 4:3. Having the height of the deodorant stick relative to the breadth of the deodorant stick within these ranges has been found to enhance the strength of the stick composition and to reduce its tendency to fracture or shear off.

Herein, "stick breadth" is the minimum cross-sectional diameter of the stick. For a stick having an oval cross-section, this equates to the minor axis of the oval.

Herein, "oval cross-section" is the cross-section when viewed from above.

In preferred embodiments, the ratio of the height of deodorant stick composition to the height of the holding material is from 1:2 to 3:2. It is particularly preferred that this ratio is from 2:3 to 1:1.

Herein, the "holding material" consists of the holder and the retaining matter and the height of the holding material includes the height of both of these components when they are engaged.

Having the height of the deodorant stick relative to the height of the holding material within these ranges has been found to enhance the strength of the stick composition and to reduce its tendency to fracture or shear off.

The deodorant stick composition is generally formed and attached to the retention member by a hot-fill process whereby molten product is typically poured into a mould, placed in contact with the retaining member whilst still molten and then allowed to cool to form a solidified stick composition attached to the retention member.

The retaining member holds the stick composition on its upper surface. The retention of the stick composition is enhanced by the retaining member comprising arcuate bridge structures separated by holes, the bridge structures arcing into the deodorant stick composition and being embedded therein.

The arcuate or curved bridge structures project upwards into the deodorant composition. The arc or curve of the bridge structures is along the long axis of said bridge structures.

In preferred embodiments, the apex of the arcuate bridge structures is at their mid-points.

In preferred embodiments, the bridge structures are entirely within the deodorant composition [when the product is fully assembled].

The holes pass fully through the retaining member from its upper surface to its lower surface. During manufacture, molten composition passes through the holes and surrounds the upwardly curving bridge structures. When the composition is solidified, the bridge structures are embedded therein. This greatly strengthens the retention of the stick composition by the retaining member, reducing the likelihood that the stick composition becomes fractured or shears off during use.

The axial immobility of the retainer member differentiates it from the majority of 'platforms' used in conventional deodorant sticks. The axial immobility of the retaining member is relative to the holder and any other associated elements.

In preferred embodiments, the product has an oval cross-section. In such embodiments, it is preferred that the arcuate bridge structures and holes therebetween pass across the breadth of the retaining member in a direction parallel to the minor axis of oval-cross-section of the product.

In preferred embodiments, the arcuate bridge structures have one or more strengthening struts running between them in a direction orthogonal to their long (major) axis. In particularly preferred embodiments, there is a strengthening strut running between each of the bridge structures in a direction orthogonal to their long axis and preferably at their mid-points.

Herein, the mid-point of the arcuate bridge structures is the mid-point along their long axis.

The one or more strengthening struts as referred to in the paragraph immediately above is particularly preferred in embodiments having an oval cross-section, especially when the arcuate bridge structures pass across the breadth of the retaining member in a direction parallel to the minor axis of oval-cross-section of the product.

It is preferred that at least one of the strengthening struts has (approximately) the same axial dimension as at least one of the arcuate bridge structures.

It is preferred that at least one of the strengthening struts has (approximately) the same width as at least one of the arcuate bridge structures. Herein, the width of a strengthening strut or an arcuate bridge structure should be understood to refer to its dimensional extent across its minor axis when viewed from above.

The strengthening struts not only aid the robustness of the arcuate bridge structures, but also contribute to the retention of the stick composition by the retaining member.

The retaining member may be reversibly connected to the holder by any suitable means. For example, the two may be held together by a screw-fitting, by a simple friction fit or snap fit, by means of magnets, by other mechanism means.

A particular means for reversibly connecting the retaining member and the holder is a mechanism involving tongue and groove attachment, particularly for products having an oval cross-section.

In preferred embodiments, the retaining member is reversibly connected to the holder by a "twist bayonet" attachment. In such embodiments, the retaining member comprises one of a bayonet element and a socket and the holder comprises the other of the bayonet element and the socket, and the bayonet element is lockably receivable within the socket such that the retaining member is removably connectable to the holder. Typically, the retaining member comprises a first connection surface from which the bayonet element extends, and the holder comprises a second connection surface on which the socket is positioned. In embodiments as described in the paragraph immediately above, the socket may comprise a retention shelf, and the bayonet element may comprise a protrusion engageable with the retention shelf, such that when the protrusion is engaged with the retention shelf the bayonet element is locked within the socket. Typically, the bayonet element comprises a pair of flanges and each flange comprises a protrusion.

In embodiments as described in the above two paragraphs, the retaining member may comprise one of a detent and an indent and the holder comprise the other of the detent and the indent, wherein the indent is adapted to receive the detent. In such embodiments, the bayonet element is typically rotatable relative to the socket between a first position and a second position such that in the first position the radial protrusion is not engaged with the retention shelf, and the detent is not received by the indent and in a second position the radial protrusion is engaged with the retention shelf and the detent is received by the indent.

The holder is designed to reversibly connect with the retaining member and is designed to allow the product to be held in the human hand. The holder enables easy application of the deodorant stick composition to the skin of the human body.

In preferred embodiments, the holder has a flat base. This allows the product to sit conveniently on a flat surface such as a bathroom shelf.

In preferred embodiments, the deodorant stick product comprises a cap which sits over the deodorant stick composition and contacts the holder.

The packaging components (e. g., cover, retaining member and holder) according to the present invention can be made of conventional materials for solid stick product packages (e. g. plastic materials). The packaging components can be made by conventional injection moulding techniques, with the material of construction preferably being a thermoplastic material having suitable rigidity to withstand forces which the device will experience when the product is filled by a hot-fill technique into the package and when the consumer uses the product. The materials of construction must be able to withstand hot-fill temperatures without deformation, having a heat of deformation of greater than 50° C., preferably greater than 60° C., more preferably greater than 70° C. and most preferably greater than 80° C. Exemplary of materials that may be used are polyolefins, such as polypropylene or polyethylene, in particular high density polyethylene.

BRIEF DESCRIPTION OF THE FIGURES

FIG. 1 is a perspective view of a deodorant stick product (1) according to the invention with the deodorant stick composition (2) and associated retaining member (3) separated from the holder (4).

FIG. 2 is a front view of a deodorant stick product (1) as illustrated in FIG. 1 minus the deodorant stick composition and plus a cap (5) shown as partially transparent.

FIG. 3 is a perspective view of the deodorant stick composition (2), associated retaining member (3) and the separated holder (4) as illustrated in FIG. 1, with the retaining member (3) about to be slid into the holder (4).

FIG. 4 is an exploded cross-sectional perspective view of the packaging elements illustrated in FIG. 2, again shown with the cap (5) shown as partially transparent.

FIGS. 9 to 17 are illustrations of a further embodiment of the first aspect of the invention. The Figures are not necessarily to the same scale.

FIG. 9 is a schematic representation of this further embodiment.

FIG. 10 is a top view of the retaining member shown in FIG. 9.

FIG. 12 is a cross-sectional view of the deodorant stick product of FIG. 9 showing the bayonet element and the socket.

FIG. 13 is a view of the deodorant stick product shown in FIG. 9 showing the retaining member positioned ready to connect with the holder.

FIG. 14 is a cross-sectional view of the retaining member and the holder positioned as they are in FIG. 13.

FIG. 15 is a view of the deodorant stick product (501) shown in FIG. 9, showing the retaining member connected to the holder;

FIG. 16 is a cross-sectional view of the retaining member and the holder positioned as they are in FIG. 15.

FIG. 17 is close-up view of the retaining member of FIG. 9, positioned in the process of attachment to the holder.

DETAILED DESCRIPTION

Figure 1:
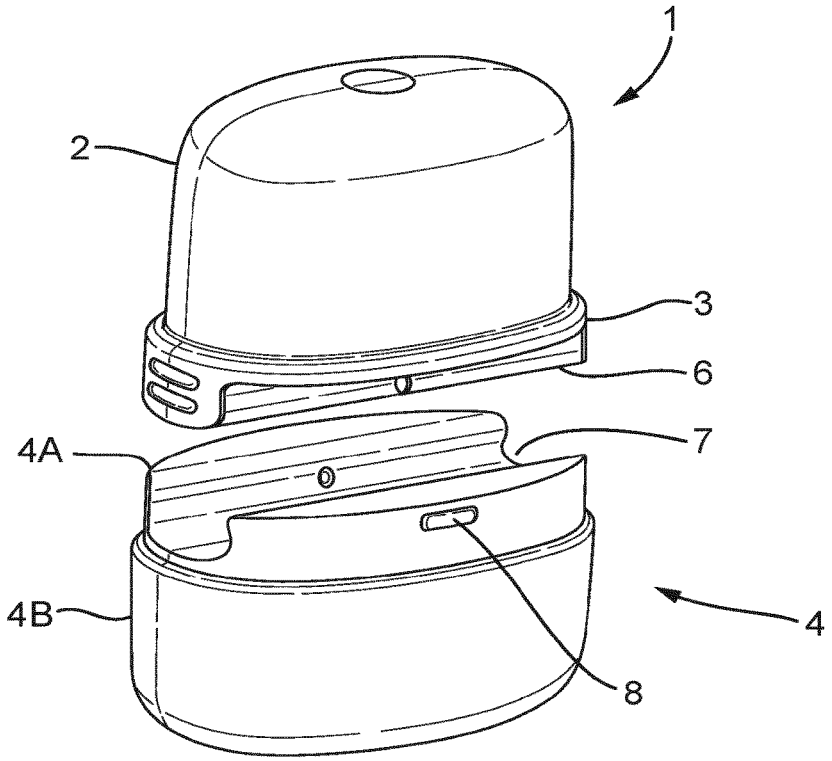
FIGS. 1 to 4 represent a first embodiment of the first aspect of the invention. The Figures are not necessarily to the same scale.

FIG. 1 shows a deodorant stick composition (2) sat on an associated retaining member (3) separated from a holder (4) into which the retaining member (3) is designed to slot. When put together, a tongue (6) on the underside of the retaining member (3) is slotted into a groove (7) in the upper side of the holder (4). The holder (4) is comprised of two elements: an upper element (4A) in which the groove (7) sits and a lower element (4B) holding the upper element (4A). Typically, the upper element (4A) and the lower element (4B) are moulded independently and then fitted together.

Also illustrated in FIG. 1 is a small projection (8) from the side of the holder (4) designed to aid retention of a cap (5) and designed to fit over the deodorant stick composition (2).

Figure 2:
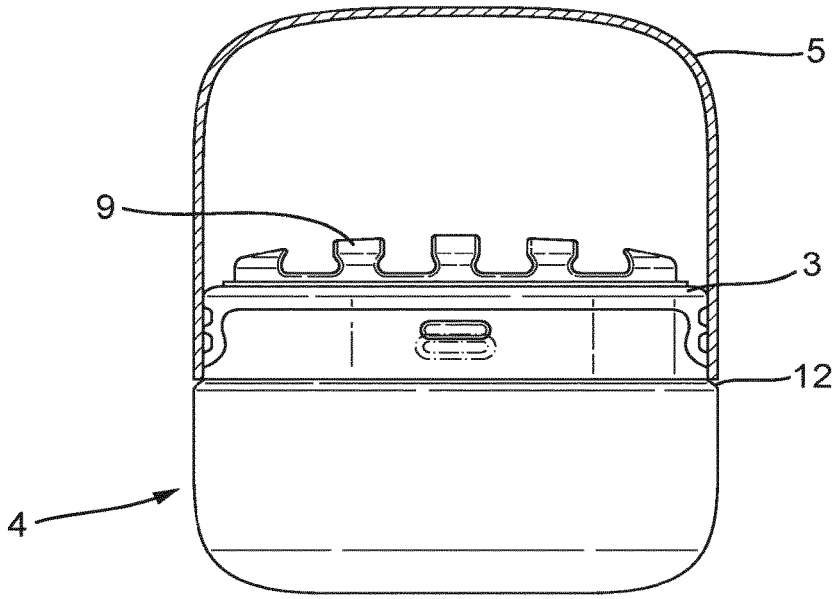

FIG. 2 illustrates the deodorant stick product (1) without its deodorant composition (2), but with a cap (5) shown over the space where the deodorant composition would sit and connecting with the holder (4). This Figure also illustrates arcuate bridge structures (9) that rise from the oval surround (3A) of the retaining member (3) and protrude into the deodorant stick composition (2) when it is in place. These bridge structures (9) serve to aid the retention of the composition (2) on the retaining member (3), particularly when the composition is being topically applied.

Figure 3:
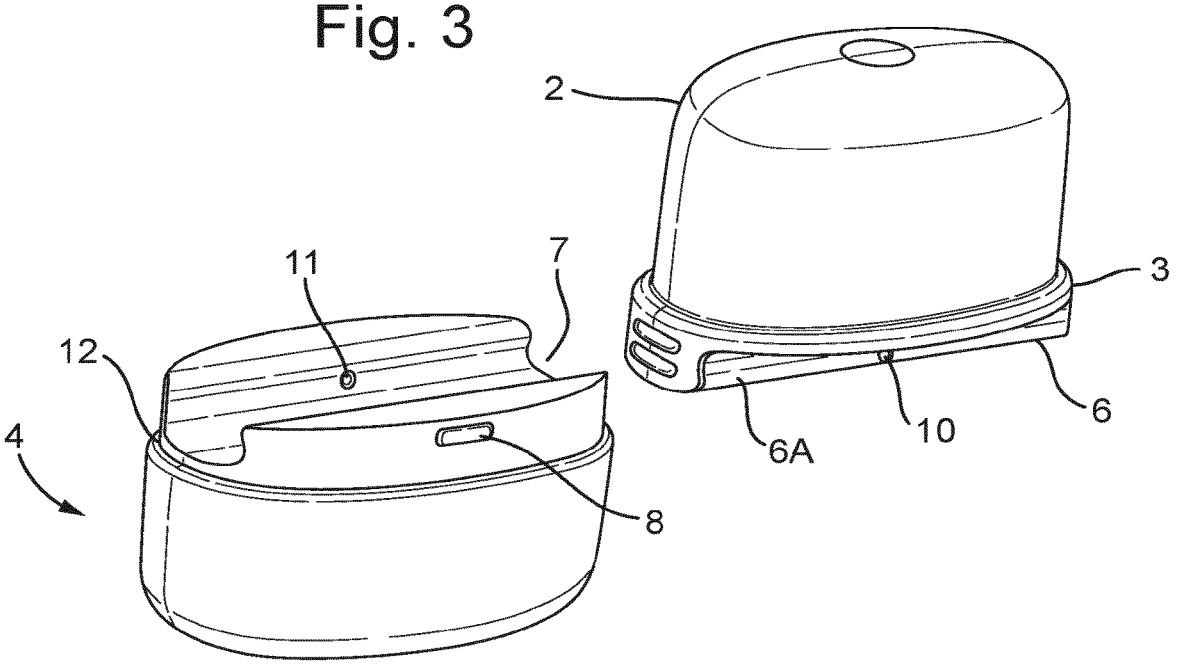

FIG. 3 illustrates the deodorant stick composition (2) and its associated retaining member (3) slid out of the holder (4). Also illustrated are the tongue (6) and groove (7) features first illustrated in FIG. 1. FIG. 3 shows that the tongue (6) depending from the retaining member (3) bears a bead (10) which is designed to click into a hollow (11) in the groove (7) when the two are fully slotted together. The interaction between the bead (10) and the hollow (11) serve to aid the retention of the tongue (6) within the groove (7) and also provide a tactile and sometimes audible signal to the consumer of when the stick composition (2) and its associated retaining member (3) has been fully loaded into the holder (4).

Figure 4:
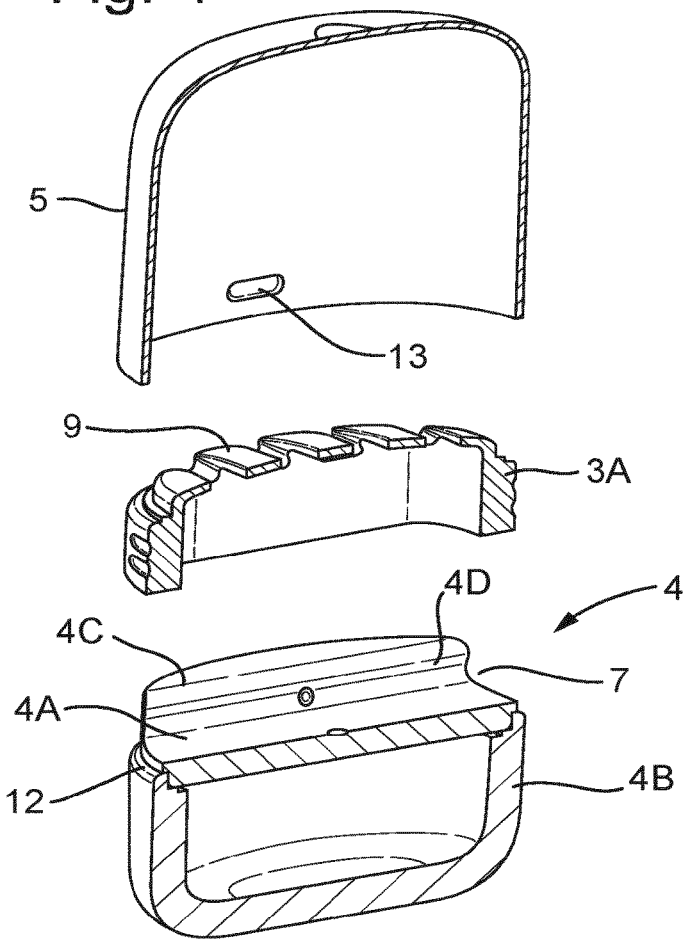

Also illustrated in FIG. 3 is a ledge (12) around the outer perimeter of the holder (4). The lower edge of a cap (5), as illustrated in FIGS. 2 and 4, sits on this ledge (12) when such a cap (5) is employed. The ledge (12) is also illustrated and labelled in FIG. 2 and FIG. 4.

FIG. 4 shows cross-sections of each of the cap (5), the retaining member (3) and the holder (4), as illustrated in one or more of the previous figures. The cross-section of the cap (5) shows a retaining ring (13) on its inner surface, designed to accommodate the small projection (8) from the side of the holder (4) when the cap (5) is slid into place. The projection (8) from the side of the holder (4) and the retaining ring (13) on the inner surface of the cap (5) form a reversible "click-lock" retaining means for the cap (5) on the holder (4).

FIG. 4 also illustrates the bridges structures (9) of the retaining member (3) in more detail. These key features arc upwards from an oval surround (3A) of the retaining member (3) into the deodorant stick composition (2), enhancing its retention.

FIG. 4 also illustrates the holder (4) in more detail. As previously mentioned, it is comprised of two elements, including the upper element (4A) in which the groove (7) sits. The groove (7) is in part defined by opposing internal walls (4C) of the holder (4), specifically of the upper element (4A) of the holder (4). The opposing internal walls (4C) have a concave surfaces (4D) along the length of the groove (7). These walls (4C) are designed to accommodate corresponding convex surfaces (6A) of the tongue (6) depending from the retaining means (3), as illustrated in FIG. 3. The concave surfaces (4D) and convex surfaces (6A) are such that the tongue (6) fits closely into the groove (7), enhancing the quality of retention between the retention member (3) and the holder (4).

Figure 5:
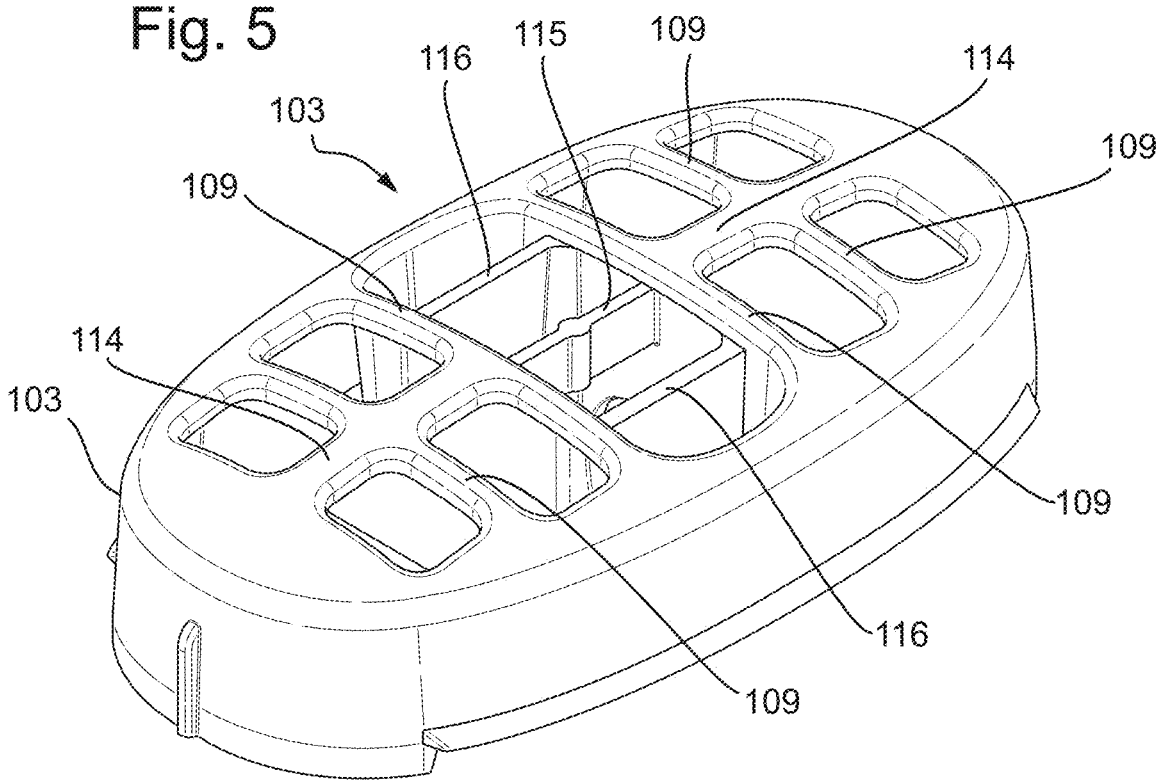
FIG. 5 is a perspective view of second embodiment of a retaining member (103) suitable for use in the present invention.

FIG. 5 shows second embodiment of a retaining member (103) for use in accordance with the invention. This retaining member (103) comprises four arcuate bridge structures (109) that rise from an oval surround (103A) of the retaining member (103) and protrude into the deodorant stick composition when it is in place. The retaining member (103) also comprises strengthening struts (114, 115, 116) running between the bridge structures (109) in a direction orthogonal to the long axis of the bridge structures (109). Some of these (114 and 115) run between the mid-points of the bridge structures (109) essentially forming a strengthening strut that runs between each of the arcuate bridge structures (109) in a direction orthogonal to their long axis. Three of the strengthening struts (115 and 116 [of which there are two]) run between the most central of the bridge structures (109), viewed along the long axis of the retaining member (103). This design of bridge structures (109) and strengthening struts (114, 115, 116) has been found to give particularly good retention of an associated deodorant stick composition (vide infra).

Figure 6:
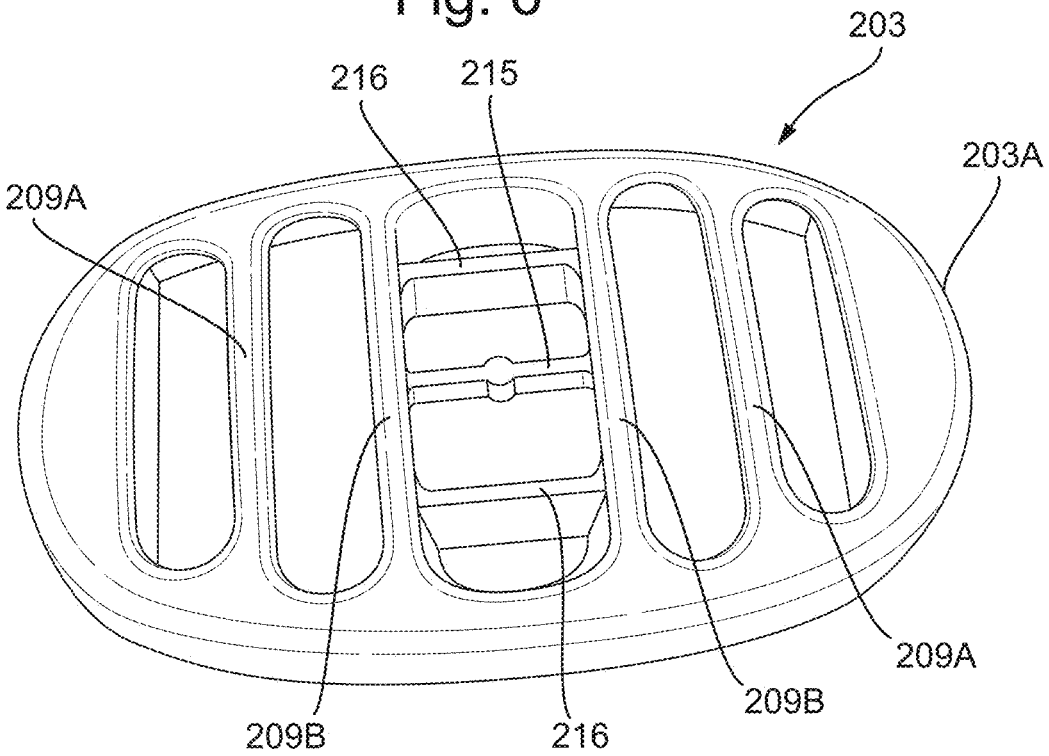
FIGS. 6 and 7 are top views of two further embodiments of retaining members (203 and 303) suitable for use in the present invention.

FIG. 6 shows a further embodiment of a retaining member (203) for use in accordance with the invention. This retaining member (203) comprises four arcuate bridge structures (209A and 209B) that rise from an oval surround (203A) of the retaining member (203) and protrude into the deodorant stick composition when it is in place. The retaining member (203) also comprises three strengthening struts (215, 216) running between the central bridge structures (209B) in a direction orthogonal to the long axis of the bridge structures (109).

Figure 7:
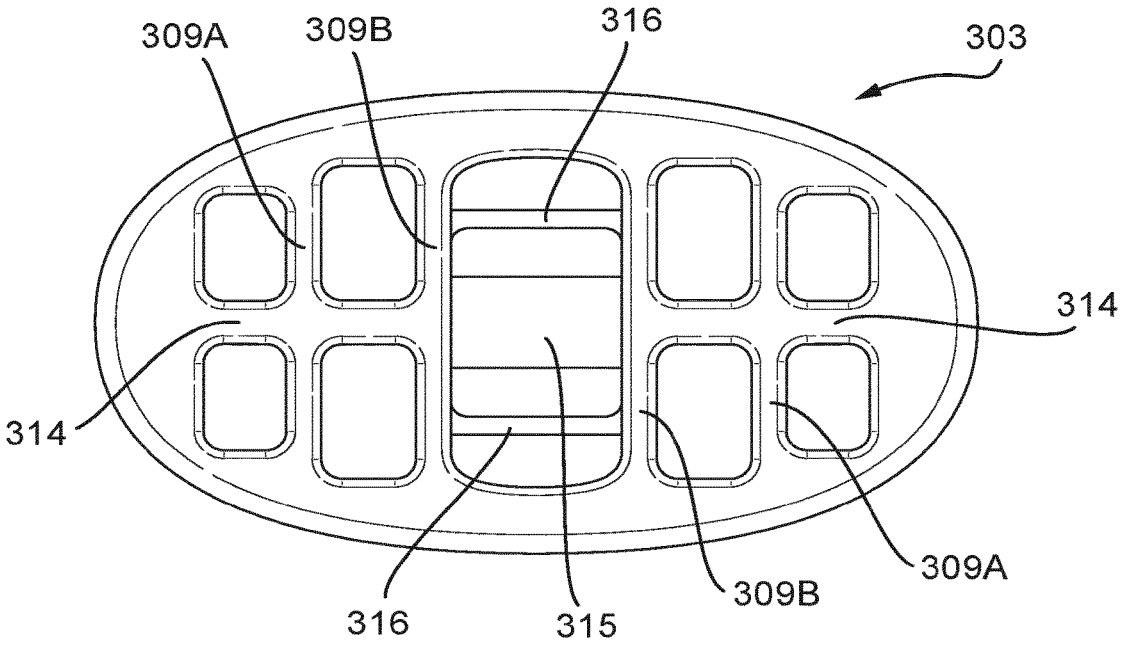

FIG. 7 shows a further embodiment of a retaining member (303) for use in accordance with the invention. This retaining member (303) comprises four arcuate bridge structures (309A and 309B) that rise from an oval surround (303A) of the retaining member (303) and protrude into the deodorant stick composition when it is in place. The retaining member (303) also comprises strengthening struts (314, 315, 316) running between the bridge structures (309) in a direction orthogonal to the long axis of the bridge structures (309A and 309B). Some of these (314 and 315) run between the mid-points of the bridge structures (309A and 309B) essentially forming a strengthening strut that runs between each of the arcuate bridge structures (309) in a direction orthogonal to their long axis. Three of the strengthening struts (315 and 316 [of which there are two]) run between the most central of the bridge structures (309), viewed along the long axis of the retaining member (303).

Independent deodorant stick products according to the invention were prepared using the retaining member (203) illustrated in FIG. 6 and the retaining member (303) illustrated in FIG. 7. A molten deodorant composition was poured through the retaining member into a polyurethane mould (not illustrated) to a level covering the arcuate bridge structures and the strengthening struts. The deodorant sticks, which were identical in composition and method of manufacture were then allowed to cool and solidify and the moulds were subsequently removed. The resulting solid stick compositions were of the same size and shape.

Figure 8:
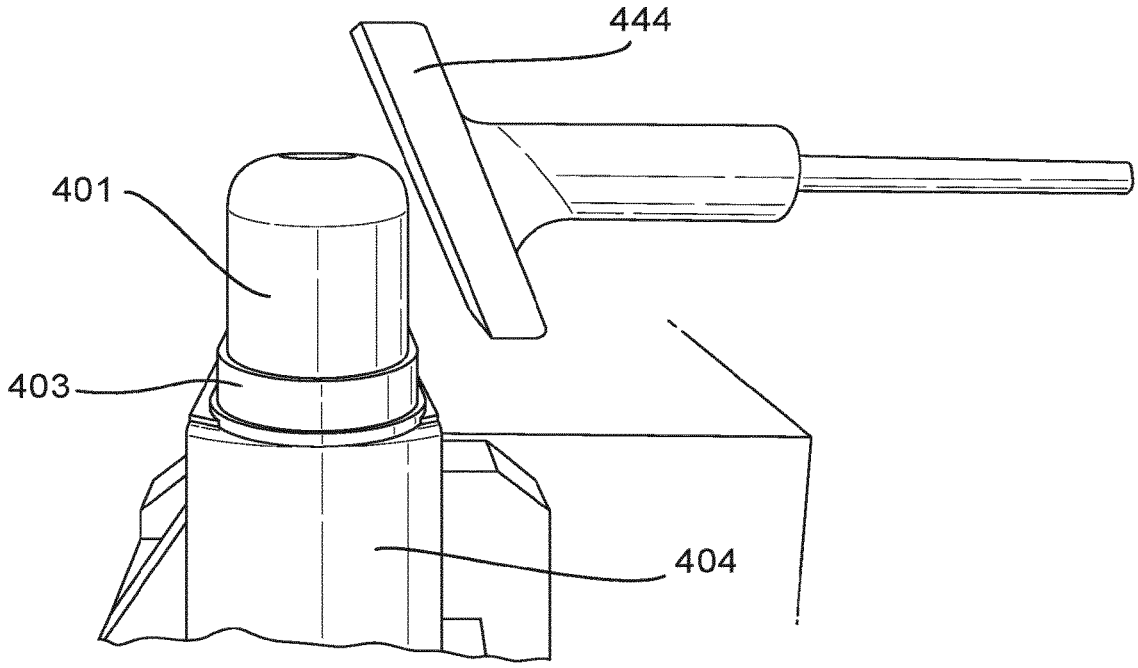
FIG. 8 is an image of testing equipment being used to evaluate a packaged deodorant stick product according to the first aspect of the invention.

The deodorant stick products as described above were tested to assess the bonding strength of the stick composition to the retaining member. The test involved the use of a 100 N mechanical force gauge on a motorised test stand and its use is illustrated in FIG. 8 and described below.

The deodorant stick composition and its associated retaining member were fitted into a holder in accordance with the invention and the holder was firmly clamped. A plate angled at 20° from the vertical was advanced into the side of the deodorant composition at a speed of 40 mm/min. The centre of the plate was aligned with the top of the stick. This is illustrated in FIG. 8 in which the deodorant stick composition (401) sits on its retaining member (403) which is attached to a holder (404) and a plate (444) is pushed sideways into the stick composition.

The force required to shear the deodorant composition from its retaining member was measured for several samples. This force is herein referred to as the bonding force. The results are shown in Table 1.

TABLE 1

| Retaining member (203) as shown in FIG. 6 | | Retaining member (303) as shown in FIG. 7. | |
|---|---|---|---|
| Sample | Bonding force (N) | Sample | Bonding force (N) |
| 1 | 8.96 | 1 | 21.84 |
| 2 | 12.78 | 2 | 17.64 |
| 3 | 10.64 | 3 | 23.52 |
| 4 | 9.54 | 4 | 22.26 |
| 5 | 12.60 | 5 | 20.84 |
| 6 | 11.84 | 6 | 20.94 |
| Mean | 11.06 | Mean | 21.17 |
| Std. Dev. | 1.60 | Std. Dev. | 1.99 |

The bonding force of the stick composition to its retaining member was significant for both retaining members; however, the retaining member (303) as shown in FIG. 7 had by far the stronger binding force to its composition. The axial depth of the bridge structures in the retaining members tested was the same for both and the retaining members were each fitted to the holders by the same means, namely a bayonet fitting on the retaining means locking into a socket in the holder.

Figure 9:
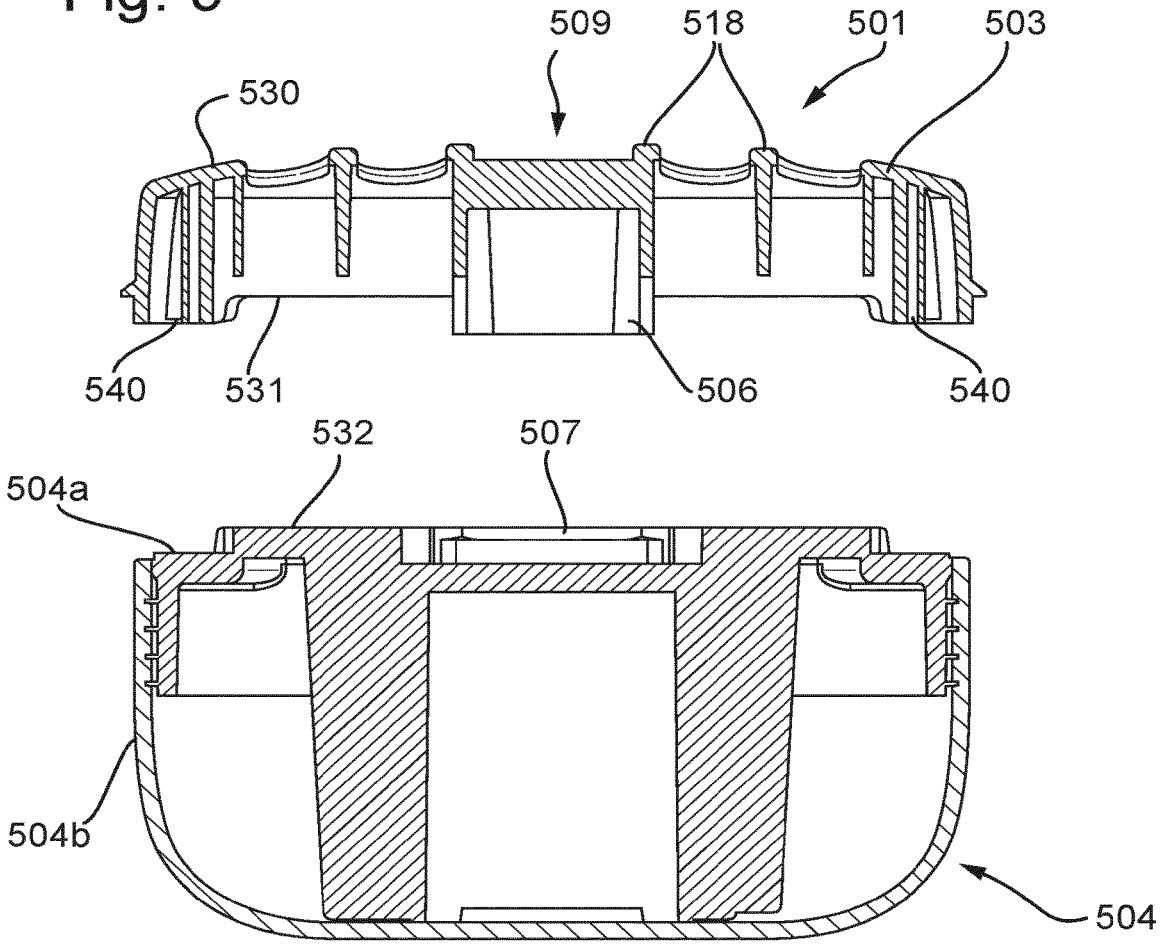

In FIG. 9, a deodorant stick product according to a further embodiment of the first aspect of the invention is illustrated. The deodorant stick product (501) comprises a retaining member (503) and a holder (504) which are shown here separated from one another.

The retaining member (503) comprises a bayonet element (506), a retaining structure (509), a retaining surface (530), a first connection surface (531) and a pair of end portions (540). The bayonet element (506) extends from the first connection surface (531) which is spaced apart from the retaining surface (530). An end portion (540) extends parallel to the bayonet element (506) from each end of the retaining member (503).

A deodorant stick composition (not shown) may be mounted to the retaining member (503) wherein the retaining structure (509) is embedded within the deodorant stick composition and the deodorant stick composition extends from the retaining surface (530). The retaining structure (509) comprises a plurality of bridge structures (518) which projects away from the first connection surface (531).

The holder (504) comprises an upper element (504A) and a lower element (504B). The upper element (504A) comprises a second connection surface (532) and a socket (507) positioned on the second connection surface (532). The lower element (504B) is adapted to receive and hold the upper element (504A). Typically, the upper element (504A) and the lower element (504B) are moulded independently and then fitted together.

Figure 10:
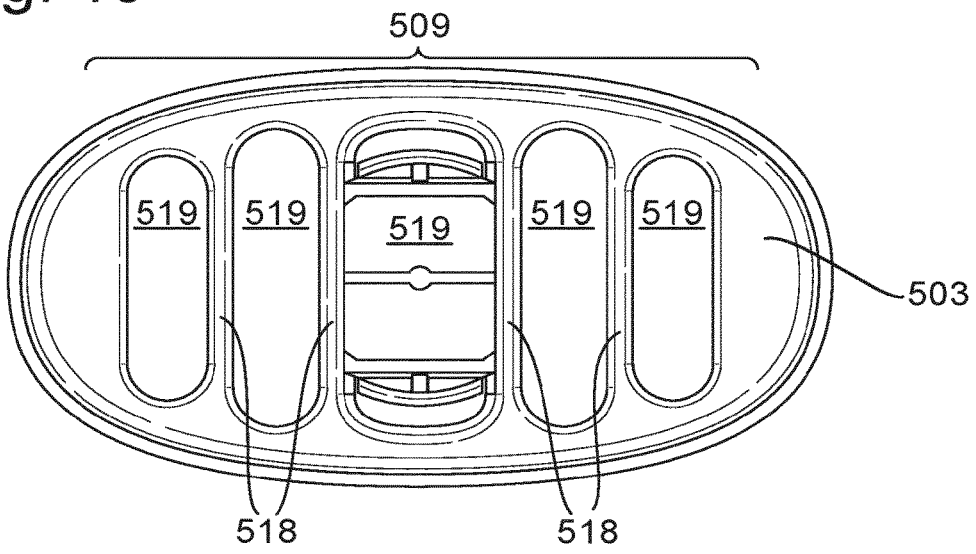

In FIG. 10, the retaining structure (509) of retaining member (503) is shown in more detail. In this embodiment of the invention the retaining structure (509) comprises four bridge structures (518). Each bridge structure (518) forms a bridge extending from one side of the retaining member (503) to the other substantially parallel to the minor axis of the retaining member (503).

The retaining structure (509) further comprises a plurality of apertures (519) that separate the bridge structures and that extend through the retaining member from the retaining surface (530) to the first connection surface (531).

Figure 11A:
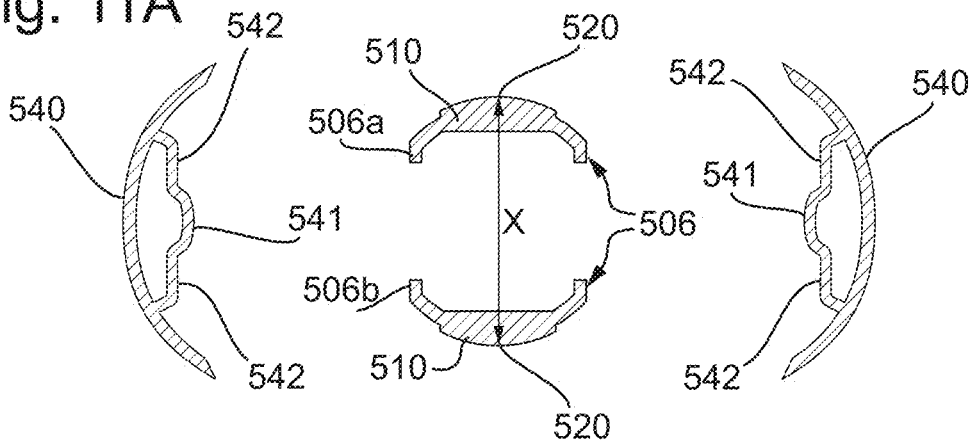
FIG. 11A is a cross-sectional representation of a bayonet element forming part of the retaining member of FIG. 9.
Figure 11B:
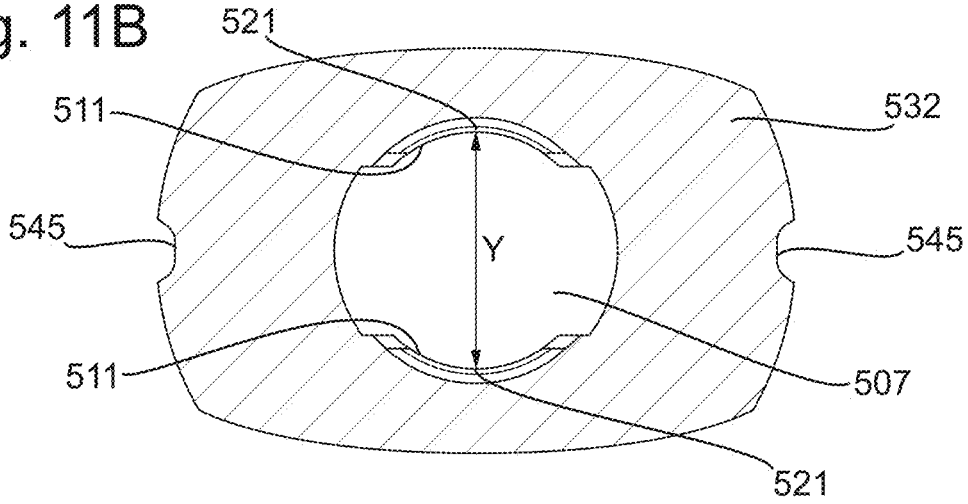
FIG. 11B is a cross-sectional representation of a socket forming part of the holder of FIG. 9.

In FIGS. 11A and 11B, the bayonet element (506), end portions (540) and socket (507) are shown in more detail. In FIG. 11A, a cross-section of the bayonet element (506) and the end portions (540) is provided. In this embodiment the bayonet element (506) comprises a pair of flanges (506*a*, 506*b*) wherein each flange extends parallel to one another from the first connection surface (531) of the retaining member (503).

Each flange (506*a*, 506*b*) comprises a protrusion (510) that extends outwards from the bayonet element (506). Each protrusion (510) comprises an outside edge (520) wherein the distance between the outside edge (520) of each protrusion (510) is shown as X.

Each end portion (540) comprises a detent support (542) and each detent support (542) comprises a detent (541).

In FIG. 11B, a cross-section of the second connection surface (532) is shown. The socket (507) comprises a pair of retention shelves (511) that extend inwardly from an opening of the socket (507). Each retention shelf (511) comprises an inner edge (521) wherein the distance between the inner edge (521) of each retention shelf (511) is shown as Y. The protrusions (510) and the retention shelves (511) are adapted such that distance X is greater than distance Y. (The distances X and Y are also shown in FIG. 12.)

The second connection surface (532) further comprises an indent (544) at each end thereof. Each indent (545) is adapted to receive a respective detent (541).

Figure 12:
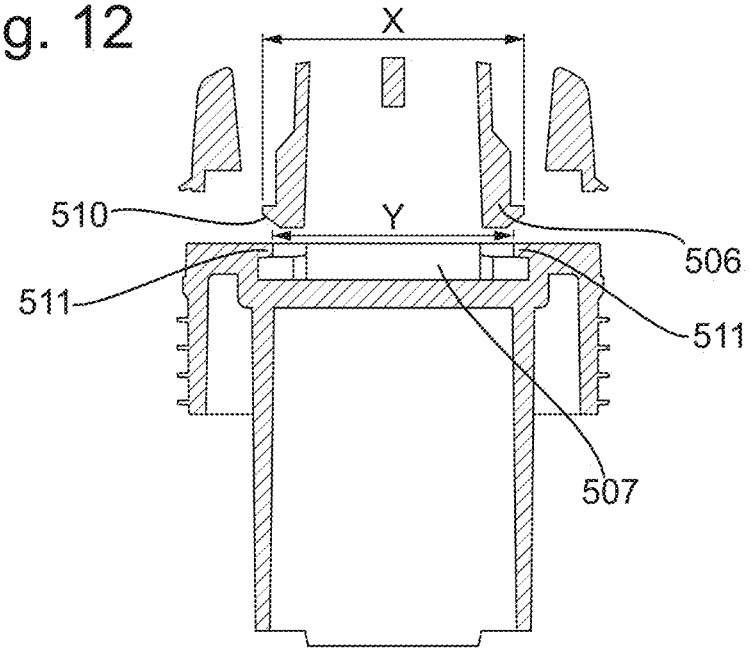

In FIG. 12, a cross-sectional view of the retaining member (503) and the upper element of the holder (504A) is shown. Here the protrusions (510) are shown extending outwardly from the bayonet element (506) and the retention shelves (511) extend inwardly from the opening of the socket (507). It can be seen that, in this orientation, the bayonet element (506) cannot be fully inserted into the socket (507) because distance X is greater than distance Y. Or in other words, the retention shelves (511) prevent movement of the protrusions (510) into the socket (507).

Figure 13:
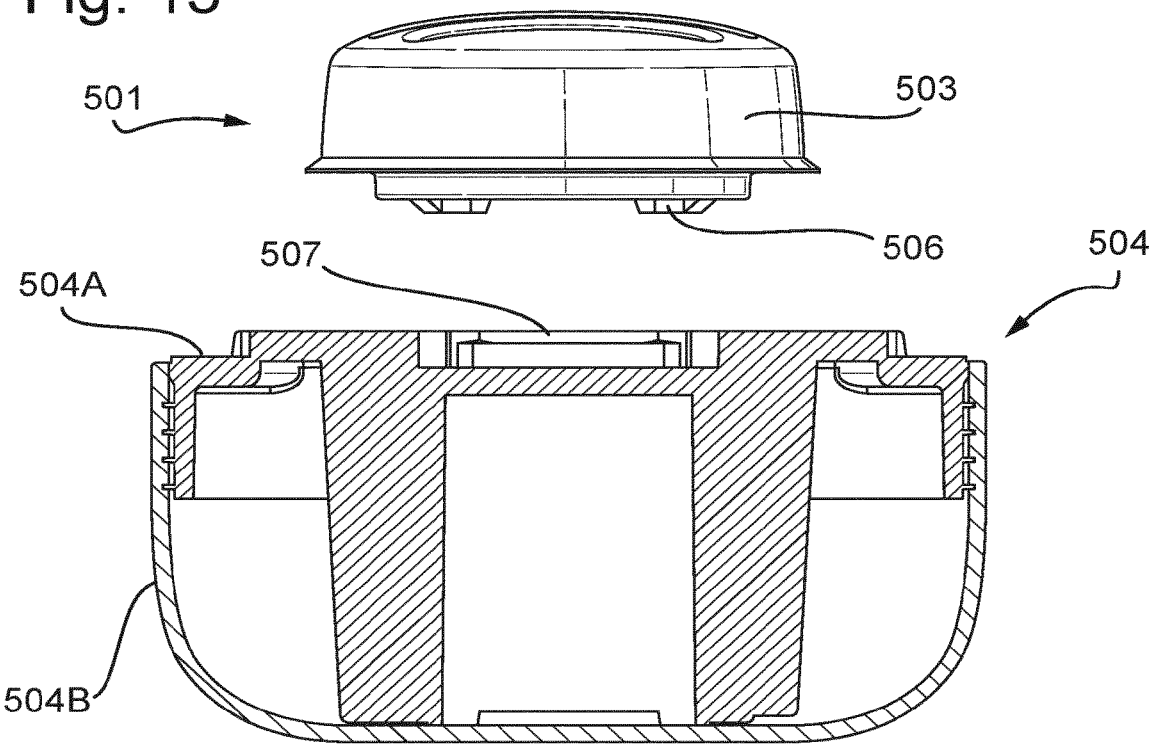

In FIG. 13, the deodorant stick product (501) is shown with the retaining member (503) positioned ready to be connected with the holder (504). The bayonet element (506) may be is inserted into the socket (507) by lowering the retaining member (503) into contact with the holder (504).

Figure 14:
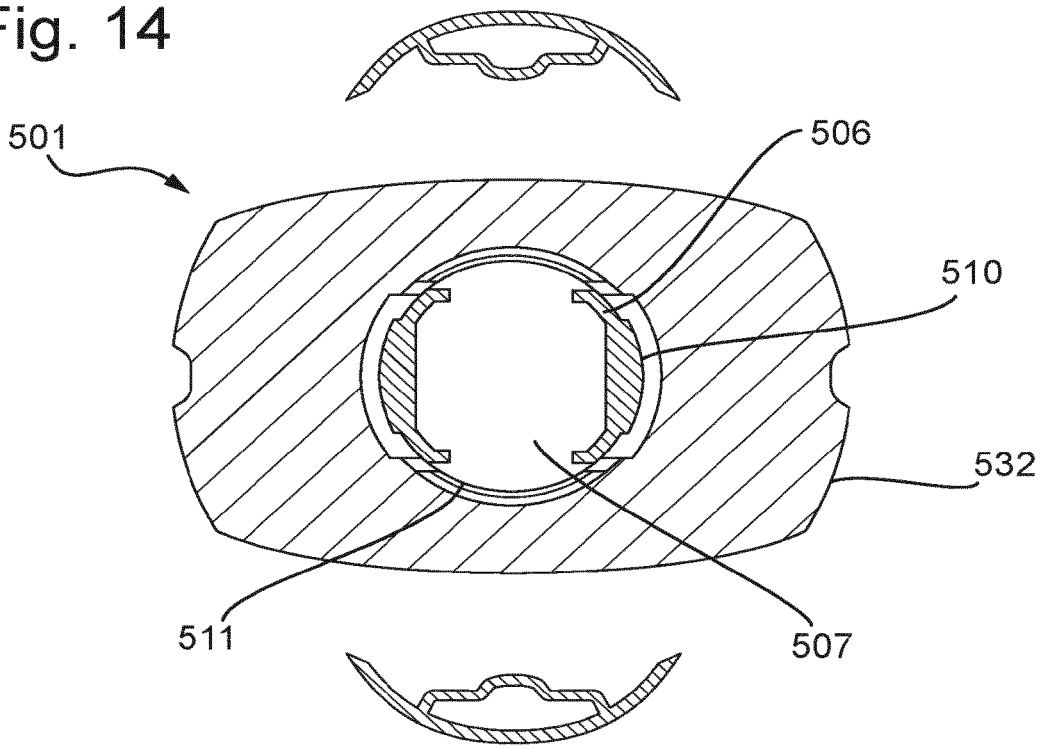

In FIG. 14, a cross-sectional view is provided of the deodorant stick product (501) in the configuration shown in FIG. 13. It can be seen that, in this orientation, the relative positions of the socket (507) and the retention shelves (511) allow the bayonet element (506) to be fully inserted into the socket (507) when the bayonet element (506) is in a first position wherein the protrusions (510) are not engaged with the retention shelves (511).

Once the bayonet element (506) is inserted into the socket (507) in the orientation shown in FIG. 14, the protrusions (510) sit lower in the socket (507) than the retention shelves (511). This allows the bayonet element (506) to be rotated from the first position to a second position wherein the protrusions (510) slide under the retention shelves (511) such that the protrusions (510) are engaged with the retention shelves (511).

The rotation may be achieved by rotating the retaining member (503) relative to the holder (504) about its central axis by 90° (or vice versa).

Figure 15:
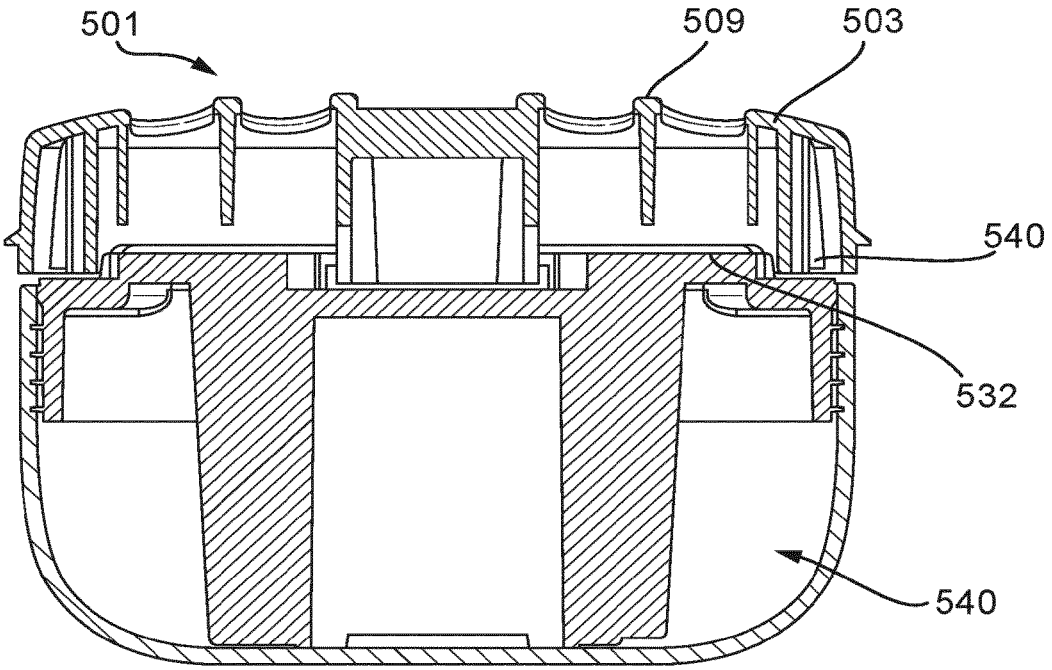

In FIG. 15, the bayonet element (506) is in the second position and the retaining member (503) is thereby connected to the holder (504). In this orientation, the end portions (540) extend past the ends of the second connection surface (532). This allows the detents (541) to be received by the indents (545) (as is shown in FIG. 16).

Figure 16:
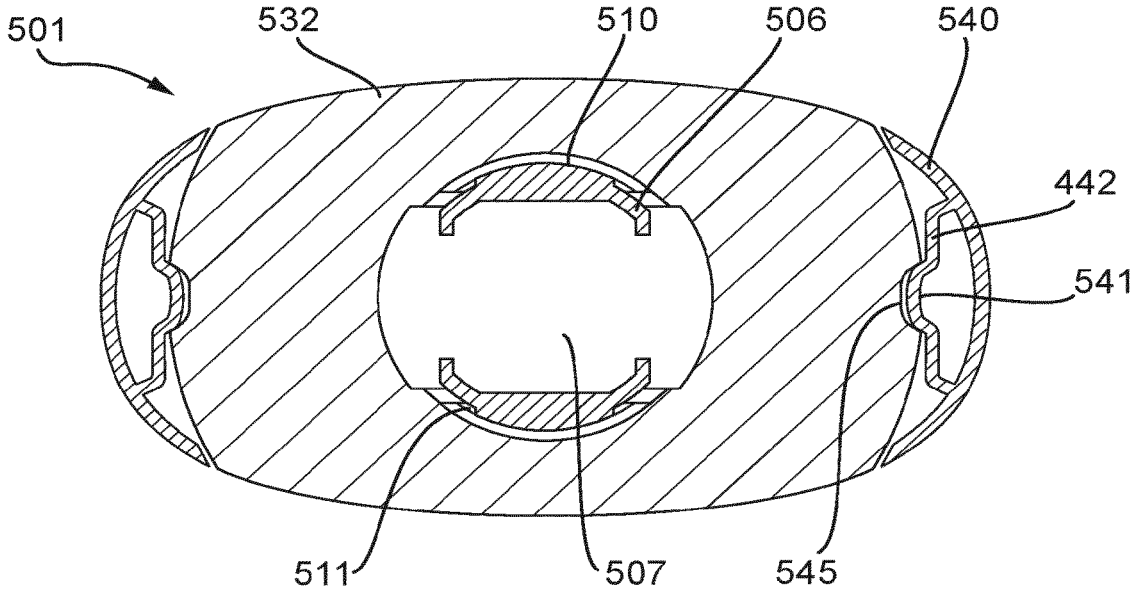

In FIG. 16, a cross-sectional view of the deodorant stick product shown in FIG. 15 is provided. As shown, the retention shelves (511) overlap the protrusions (510), and therefore the protrusions (510) engage with the retention shelves (511). This means that the bayonet element (506) is locked within the socket (507) until the bayonet element (506) is rotated back to the first position.

In order to prevent the bayonet element (506) from rotating back to the first position accidentally, the indents (545) are adapted to receive the detents (541) when the bayonet element (506) is in the second position.

Herein, the maximum diameter of the second connection surface (532) is defined as the largest possible distance between any two points on the perimeter of the second connection surface (532). Herein, the minimum distance between the pair of detents (541) is defined as the smallest possible distance between a point on one of the pair of detents and a point on the other of the pair of detents. The pair of detents are integrally formed as part of the retaining member, therefore the minimum distance between them is set by the size and shape of the retaining member.

Figure 17:
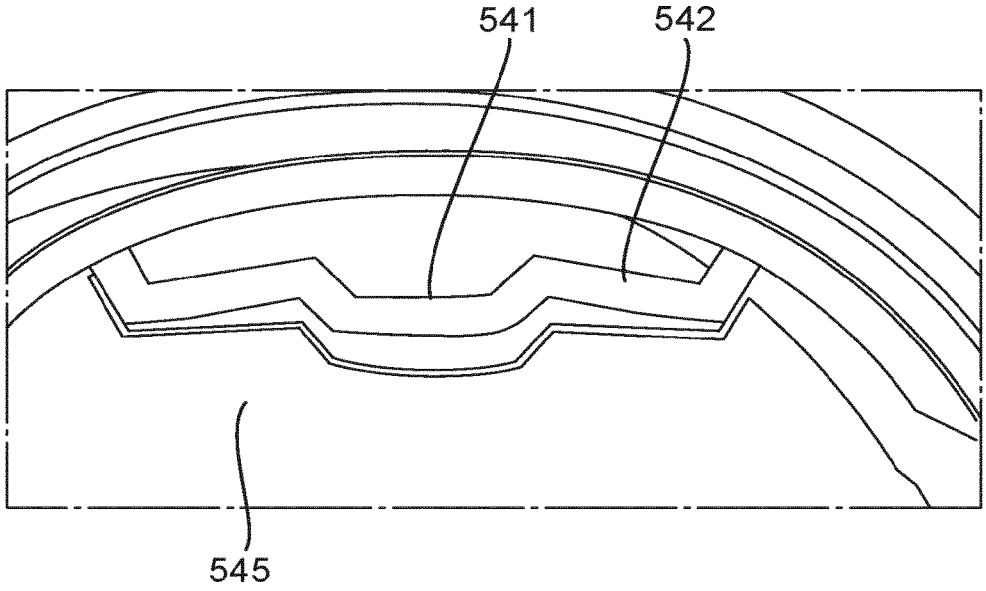

The maximum diameter of the second connection surface (532) is adapted to be greater than the minimum distance between the pair of detents (541). Therefore in order for the retaining member (503) to be rotated relative to the holder (504) so that the bayonet element (506) can rotate from the first position to the second position, each detent support (542) deforms as shown in FIG. 17 to allow each detent (541) to move outwards (away from the bayonet element (506), thereby increasing the minimum distance between the pair of detents (541). The outward movement of the detents (541) allows the bayonet element (506) to be rotated fully towards the second position.

The shape of each end portion (540) is adapted such that a rotational force applied to the retaining member (503) causes the detents (541) to slidably abut against the second connection surface (532) and result in the necessary deformation of the detent supports (542) to move the detents (541) sufficiently outwards.

The detent supports (542) comprise a resiliently deformable material so that when each detent (541) aligns with its respective indent (545) the detent supports (542) return to their undeformed shape and each indent (545) receives a respective detent (541). Once the configuration shown in FIGS. 15 and 16 is reached, a further rotational force is required to cause deformation to the detent supports (542) again before the detents (541) can be moved outwards and the bayonet element (506) can be rotated away from the second position. The end portions (540) are adapted such that the rotational force required to cause deformation of the detent supports (542) is larger than would typically be applied during use of the deodorant stick product (501) but also easy for a user to apply intentionally in order to connect or disconnect a retaining member (503) from a holder (504). Hence it would be unlikely that the retaining member (503) would disconnect from the holder (504) accidentally during use of the deodorant stick product (501).

Further, the end portions (540) are adapted such that the detent supports (542) may resiliently deform to allow movement of the detents (541) while the overall retaining member (503) deforms very little. This is advantageous because if the retaining member (503), and particularly the retaining structure (509), were to deform significantly when the retaining member (503) is connected to the holder then the deodorant stick composition in which the retaining structure (509) is embedded may deform also. The deodorant stick composition is a wax-like structure and is not resiliently deformable, therefore deformation of the composition may cause it to become loose from the retaining structure (509). It is very undesirable for the composition to fall off the retaining member (503), hence it is beneficial to minimize deformation of the overall retaining member (503).

The invention claimed is:

1. A deodorant stick product comprising:

a deodorant stick composition mounted on a retaining member, wherein the retaining member is reversibly connected to a holder, wherein the retaining member is axially immobile relative to the holder and any other associated elements, and wherein the retaining member comprises:

at least two parallel arcuate bridge structures separated by holes, wherein the at least two parallel arcuate bridge structures arc into the cosmetic stick composition and are embedded into the cosmetic stick composition, wherein an arc of each of the at least two parallel arcuate bridge structures is along a long axis of each of the arcuate bridge structure;

at least one additional bridge structure extending parallel to the at least two parallel arcuate bride structures;

at least one strengthening strut extending in a direction orthogonal to the long axis of each of the at least two parallel arcuate bridge structures.

2. A deodorant stick product according to claim 1, wherein a ratio of a height of the cosmetic stick composition to a breadth of the cosmetic stick composition is from 1:2 to 3:2.

3. A deodorant stick product according to claim 2, wherein the product has an oval cross-section when viewed from above.

4. A deodorant stick product according to claim 1, comprising a cap which sits over the deodorant stick composition and contacts the holder.

5. A deodorant stick product according to claim 1, wherein the cosmetic stick product has an oval or round cross-section when viewed from above.

6. A deodorant stick product according to claim 1, wherein the at least two parallel arcuate bridge structures are entirely within the deodorant stick composition.

7. A deodorant stick product according to claim 1, wherein the deodorant stick composition is an antiperspirant composition.

8. A deodorant stick product according to claim 1, wherein the deodorant stick composition has a hardness of at least 600 gram force.

9. A deodorant stick product according to claim 1, wherein the axially immobile retaining member comprises one of a bayonet element and a socket and the holder comprises the other of the bayonet element and the socket, and the bayonet element is lockably receivable within the socket such that the axially immobile retaining member is removably connectable to the holder.

10. A deodorant stick product according to claim 9, wherein the axially immobile retaining member comprises a first connection surface from which the bayonet element extends, and the holder comprises a second connection surface on which the socket is positioned.

11. A method of applying a deodorant stick composition to a surface of a human body comprising the topical application of a product according to claim 1.

12. A method of reducing perspiration comprising the use of a product according to claim 1 to topically apply a deodorant composition to a surface of a human body.

* * * * *